United States Patent [19]

Unthank

[11] 4,251,971

[45] Feb. 24, 1981

[54] MEANS FOR PLACEMENT OF WIRE MESH REINFORCEMENT IN CONCRETE SLAB CONSTRUCTION

[76] Inventor: John O. Unthank, 3425 S. 30th St., Lincoln, Nebr. 68502

[21] Appl. No.: 12,208

[22] Filed: Feb. 14, 1979

[51] Int. Cl.[3] ..... E04C 5/16

[52] U.S. Cl. ..... 52/677; 52/684

[58] Field of Search ..... 52/678, 677, 127, 126, 52/679, 680, 681, 682, 684

[56] References Cited

U.S. PATENT DOCUMENTS

| | | | |
|---|---|---|---|
| 3,520,101 | 7/1970 | Casto | 52/681 |
| 3,572,001 | 3/1971 | Munchinsky | 52/678 |

*Primary Examiner*—Carl D. Friedman

*Attorney, Agent, or Firm*—John H. Merchant

[57] ABSTRACT

Pointed novel stakes which may be of metal or plastic, adapted to be driven in alignment into the ground or bed upon which a concrete slab is to be poured, are provided with lever arms engaging a lifting wire or rod upon which reinforcing material, such as welded wire mesh is supported. The upper ends of the lever arms are adapted to be moved through an arc of about 45 degrees to a vertical position, and serve to raise the reinforcing material to a predetermined position above the bed of the slab when the lifting wires or rods are moved in a lateral direction.

7 Claims, 10 Drawing Figures

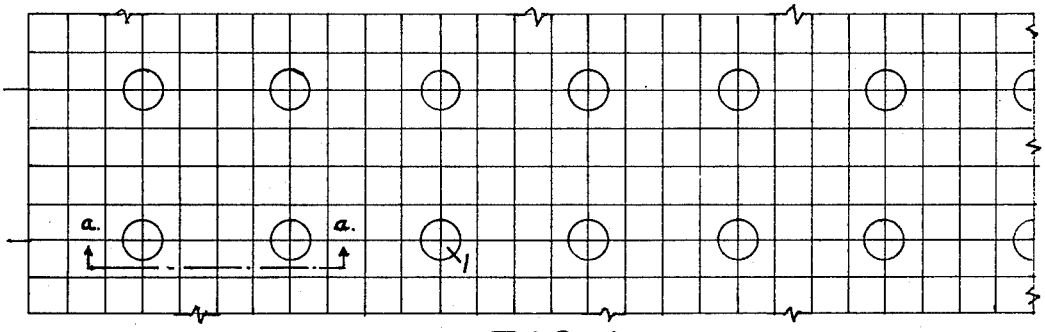
FIG. 1
FIG. 2
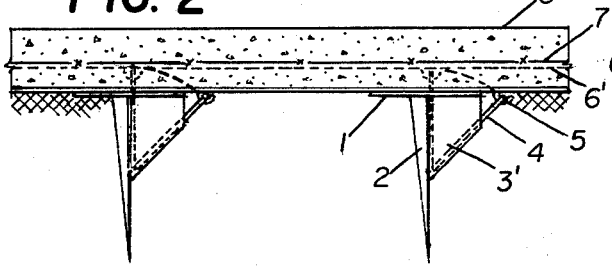
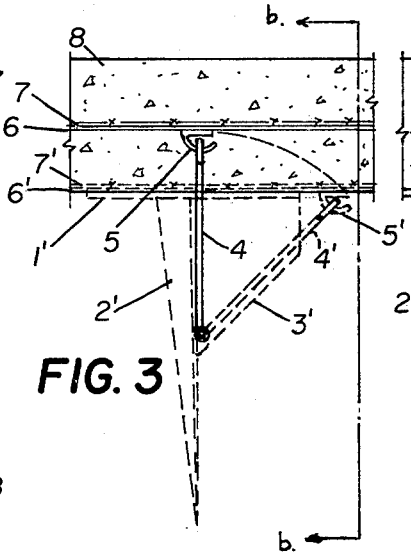
FIG. 3
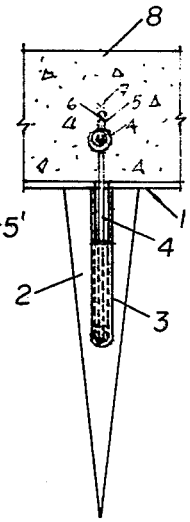
FIG. 4
FIG. 5
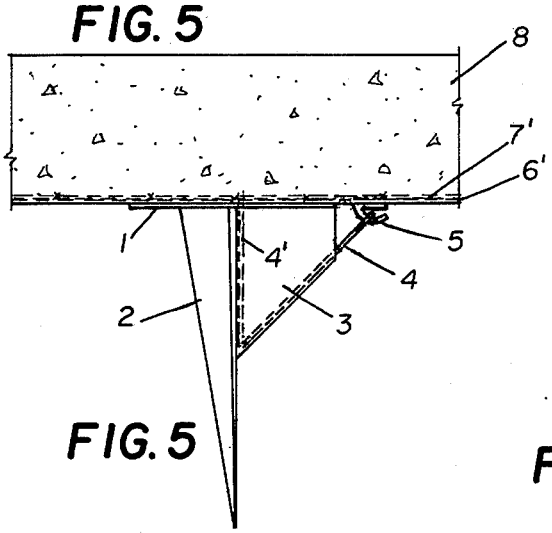
FIG. 5
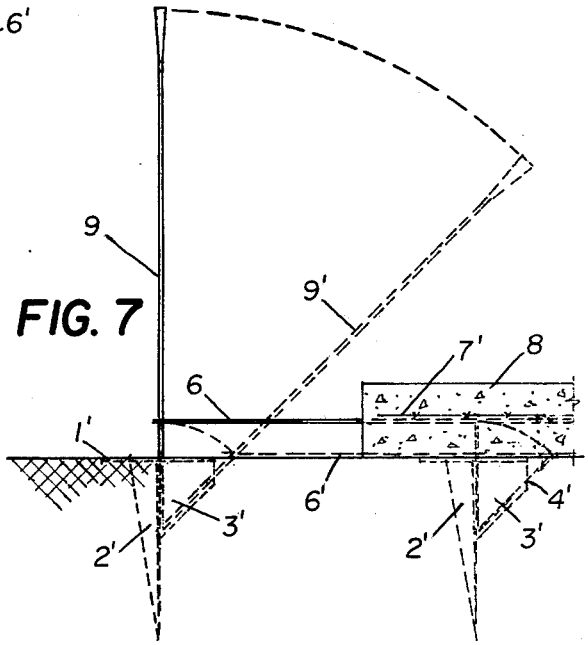
FIG. 7
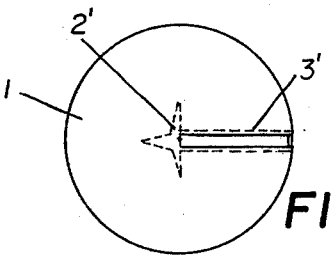
FIG. 6

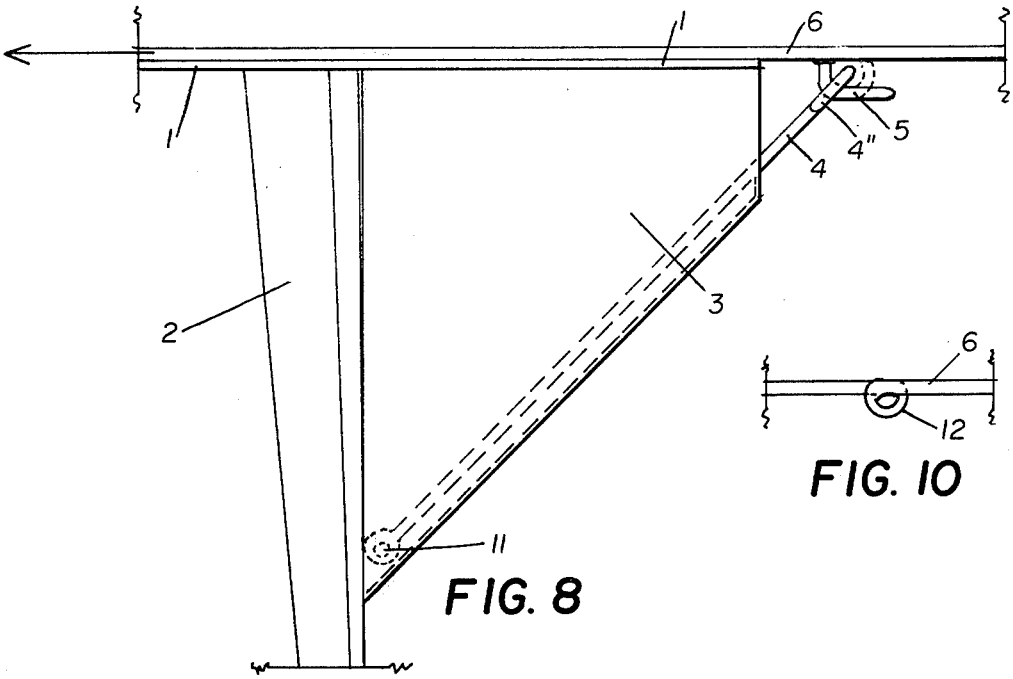
FIG. 8
FIG. 10
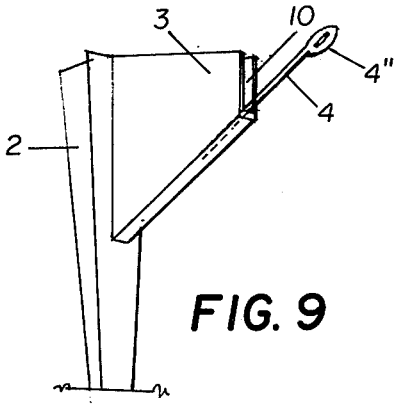
FIG. 9

MEANS FOR PLACEMENT OF WIRE MESH REINFORCEMENT IN CONCRETE SLAB CONSTRUCTION

BACKGROUND OF THE INVENTION

This invention relates to an innovative means and method for the placement of welded wire mesh normally used in the construction of poured mesh-reinforced concrete slabs. The term "slabs" refers to flat formations of concrete for use in paving, walks, drives, parking areas, and other similar items of concrete slab construction.

Mesh reinforcement, commonly referred to as "temperature" reinforcement, usually is steel woven and welded wire mesh which, when embedded in poured concrete slabs, tends to hold the concrete in place and reduce the tendency of the concrete to crack after it has hardened or "set." Concrete slabs have a tendency to crack unless expansion joints are provided, ordinarily spaced at intervals of twelve to twenty feet, depending upon the thickness of the slab. The reinforcing material distributes expansion and contraction action so that if cracking occurs, many imperceptible "hair-line" cracks are developed rather than one or several visible ones as often happens when reinforcement is improperly located within the slab thickness, or in the case of unreinforced concrete.

The normal or usual method of installing mesh reinforcement is to unroll it onto the area to receive the slab, or if the mesh is supplied in a flat shape, to place the mesh on the area prior to pouring the wet and plastic concrete.

After pouring an area of concrete to the approximate thickness of the slab desired, and while the concrete is in workable condition, the mesh is raised to the desired position, which should be midway of the slab thickness, and in the case of a four inch slab, about two inches above the bottom of the slab.

This manual method of positioning the mesh is usually accomplished by the use of a hooked or bent wire or any type of tool with which it is possible to engage a section or portion of the wire mesh in order to raise it into the wet concrete. This raising or lifting is usually done by workmen who must walk in the wet concrete, as described and shown in an article entitled "Control of Random Cracking in Exterior Residential Flatwork," Part II, appearing at page 511, in the Dec. 1971 issue of *Concrete Construction.*

The procedure described above is a haphazard and unsatisfactory method of positioning the mesh reinforcing within the slab. It is ineffective and inefficient in that:

(a) Portions of the mesh which remain at the bottom of the slab are wasted since they have no reinforcing value;

(b) Varying heights of the mesh location within the slab may actually have a damaging effect upon the slab due to the different stresses induced, i.e., portions of the mesh near the bottom of the slab may be considered to be in tension, while portions of the mesh near the top of the slab would be in compression.

These conditions occurring one or more times within a given width and/or length of a slab conceivably would induce stresses working against each other and weaken the slab to the extent of causing cracking. In view of this possibility the installation of wire mesh by the usual method may be more harmful than beneficial, as far as reinforcement is concerned.

In view of the above reasons, it follows that by positively and accurately controlling the location of the reinforcing mesh at the approximate center, or within the middle third of the thickness of the slab, a reinforced slab conforming to design requirements will be obtained.

In order to overcome the objections referred to above, it is an object of the present invention to provide means and a method of controlling the uniform and proper location of the reinforcing material, such as wire mesh, in the preparation of concrete slabs and thereby obtain a slab having the desired strength and resistance to cracking.

BRIEF SUMMARY OF THE INVENTION

In accordance with the present invention, novel stakes or pins, adapted to be driven into the ground or bed upon which the concrete slab is to be poured, are provided with pivoted mounted lever arms engaging a lifting wire or rod upon which the reinforcing material, such as wire mesh, is supported. The stakes or pins may be formed of metal, plastic, such as fiberglass, or other suitable rigid material. The upper or outer ends of the lever arms, in contact with the lifting wires or rods, serve to raise the reinforcing material when the lifting wires or rods are moved in a lateral direction, as depicted in the accompanying drawings.

The stakes or pins are placed in a line approximately two or three feet apart, the length of the line being determined by the size of the concrete slab to be poured. In the event the bed for the slab is first covered with a water-proofing film or fabric, holes punched in the covering by insertion of the stakes or pins, may be sealed with a suitable mastic.

The herein described stake or pin is provided with a body portion of triangular shape, pointed at its lower end to facilitate insertion in the bed for the slab, and in section has the form of a three pointed star. On the flat triangular face of the upper portion of the stake, there is firmly attached a casing or shield, "U-shaped" in cross-section, and generally of trapazoidal configuration. The casing or shield is open its upper and outer ends and has, adjacent its base and at approximately the mid-point of the stake, a pivotally mounted raising or lever arm, terminating at its outer end in a loop or "eye." The latter is adapted to engage a suitable fastening means, such as a hook, secured to the lifting wire or rod so that when the latter is moved laterally to the left, as viewed in the drawings, the lever arm is moved through an arc, lifting the wire or rod together with the reinforcing mesh to a predetermined height within the concrete slab.

The shield is so shaped as to limit the downward movement of the lever arm from its initial position to a vertical position through a limited arc of about 45 degrees. The pivotal point of the lever arm is located about the mid-section of the stake so that this limited movement of the lever arm as it is moved to its final vertical position, enables sufficient pressure to be applied to overcome the resistance offered by the wet concrete and raise the reinforcing material to the desired point above the bed of the slab.

Each stake has mounted on the top thereof a slotted plate, the slot being aligned with an opening in the upper portion of the casing or shield. The slot in the plate and the opening in the top of the casing serve to guide the lever arm as it is raised from its initial position to its final vertical position and insure continual contact between the loop at the end of the lever arm and the corresponding mating attachment means secured to the lifting wire or rod.

After the stakes have been positioned in a straight line on the bed on which the concrete slab is to be poured, the lifting wire or rod is laid in a line across the centers of the slotted top plates and attached to the loops forming the outer ends of the lever arms, the outer ends of the lifting wire or rod extending beyond the edge of the slab. The concrete is then poured to form a slab of the desired thickness.

While the cement is in plastic condition, the lifting wire or rod is moved laterally to the left, as viewed in the drawing, either manually or by mechanical means, by the use of a lever arm placed at the end of the slab. The lateral movement of the lifting wire or rod moves the lever arms attached to each stake through an arc of about 45 degrees, guided by the opening in the top of the shield and the slot in the top plate fastened to each stake raising the lifting wire or rod along with the reinforcing mesh to a mid-slab position. The raising wire or rod remain as a part of the finished slab.

In the event the width of the slab to be poured requires more than a single line of stakes, two or more of the lifting wires or rods extending beyond the end of the slab may be drawn in unison. When moved in this fashion, either manually or mechanically, all of the lifting arms in each line are raised simultaneously, raising the mesh reinforcement to the desired position in the slab.

BRIEF DESCRIPTION OF THE DRAWINGS

Various objects and advantages of the present invention will be apparent from the following detailed description taken in conjunction with the accompanying drawings wherein similar reference characters designate corresponding parts in each of the views, in which:

FIG. 1 is a plan view diagramming the positioning of the lifting devices in relation to the wire mesh reinforcing material;

FIG. 2 is a sectional side elevation taken along the lines a—a, of FIG. 1;

FIG. 3 is an enlarged sectional side view of one of the lifting devices shown in FIG. 2, illustrating in detail the several parts of the device, the movement of the lifting or lever arm being indicated by dotted lines;

FIG. 4 is a front elevation of the lifting device, partly in cross-section, taken along lines b—b, of FIG. 3;

FIG. 5 is an enlarged side elevation, partly in cross-section, showing the lifting device before the wire mesh is elevated to the mid-section of the slab;

FIG. 6 is a plan view showing the top plate of the lifting device;

FIG. 7 is an elevation, partly in cross-section, showing an operating arm for lateral movement of the lifting wire or rod to elevate the lifting wire or rod and the wire mesh to the mid-section of the slab;

FIG. 8 is an enlarged detail of the upper portion of the lifting device showing the manner in which the upper arm is attached to the lifting wire or rod;

FIG. 9 is a perspective view of the lifting device or stake showing in detail the open top shield enclosing the lifting arm before the attachment of the top plate, and FIG. 10 is a top view of the lifting wire or rod twisted to form a loop to engage the upper end of the lifting or lever arm. This is an alternative manner of providing a loop to receive a hook at the outer end of the lifting or lever arm.

DETAILED DESCRIPTION OF THE INVENTION

Referring to the drawings, FIG. 1, illustrates as an example, the manner in which the stakes or lifting devices may be spaced to provide support for the wire mesh reinforcement prior to pouring the concrete slab. The spacing may be varied depending upon the size and shape of the slab to be poured, the row or rows of stakes being positioned in substantial alignment.

In the drawings, the slotted top plate designated generally by the numerals 1; and 1', is fastened to the upper surface of a triangular three bladed base, 2; and 2', which in cross-section, as shown in FIG. 6, has the form of a three pointed star. The lower end of the base 2; and 2', terminates in a relatively sharp point so that it may be readily driven or forced into the earth or gravel base upon which the concrete slab is to be poured. The base may be a combination of gravel and earth, however, graded earth is usually used as the base for concrete slabs in walks, driveways, streets and parking areas.

A casing or shield, 3; and 3', is firmly secured to the upper flat face of the triangular stake, and partly houses a lifting or lever arm pivotally mounted within the lower side walls of the housing or shield by means of a bolt 11, or similar connector, at approximately the midpoint of the triangular base of the stake. The housing or shield, which is "U-Shaped" in cross-section, is open at the top and the outer exposed side, is in the form of a trapezoid, the lower surface being angled at about 45 degrees to house and support the lever or lifting arm 4, when the latter is in its lower position.

The upper end of the lifting arm 4, terminates in a loop or "eye" 4", adapted to engage a hook 5, welded or otherwise securely attached to the lifting wire 6; and 6', so that the top of the wire is smooth and will not become entangled in the wires of the reinforcing mesh. All hooks for attaching the lifting wire 6, to the lever arms 4, are located in alignment on the same side of the lifting wire and so spaced as to coincide with the lifting arms of the individual stakes.

The hook 5, welded to the lifting wire 6, as shown in dotted lines in FIG. 8, may be of wire of a weight that may be bent with plyers so that the loop can be locked in place. The hook 5, as shown in FIG. 10, may be replaced by twisting the lifting wire 6, at intervals corresponding to the distance between the stakes to form a loop 12, to engage the upper end of the lifting arms of the individual stakes. In this modification, the loop on the outer end of the lifting or lever arms are replaced with a hook to engage the loop 10, on the lifting wire 6.

In operation, after the stakes have been positioned in a straight line in the bed on which the concrete slab is to be poured, the lifting wire or wires 6; and 8', are laid in a line across the centers of the slotted top plates 1, attached to the top of the stakes, the outer end of the lifting wire or wires extending beyond the end of the slab bed, as shown in FIG. 7. The concrete is then poured to form a slab of the desired thickness.

After the slab has been poured and troweled to the desired smoothness, promptly while the cement is still in plastic condition, the lifting wire or wires 6, are moved laterally to the left, as viewed in FIG. 7, either manually or by mechanical means, by use of a lever arm 9, placed at the end of the slab. The lateral movement of the lifting wire or wires 6; and 6', moves the lifting or lever arms 4, attached to each stake, through an arc of about 45 degrees, guided by the shield or housing 3, and the slot in the top plate 1, attached to the top of each stake. The limit of movement of the lifting arms through its arc to the vertical position is at the point of its contact against the stake, and at this position the lifting wire or wires, and the reinforcing mesh will be raised to the mid-slab position. The raising wire or wires and the stakes remain as a part of the finished slab.

The length of the slab to be poured would usually require more than a single line of stakes and thus two or more of the lifting wires extending beyond the end of the slab bed may be drawn in unison. When moved in this fashion, either manually or mechanically, two or more lines of lifting arms are raised simultaneously thereby raising the lines and reinforcement mesh to the desired position in the slab.

It will be noted that the center of the arc of the lifting arm 4, is below the slab 8, in the ground or base. The center point is secured in the guiding shield 3, which is positioned and held in the ground by being connected to and being a part of the stake. The lifting arm 4, as previously mentioned, is at an angle of approximately 45 degrees relative to the lifting wire and when the lifting wire is pulled, the lifting arms move into vertical position and the lifting wire and the wire mesh supported thereon, are raised into the desired position in the slab.

This invention is capable of numerous forms and various applications without departing from the essential features herein disclosed. It is therefore intended and desired that the embodiments shown herein shall be deemed merely illustrative and not restrictive, and that the patent shall cover all patentable novelty herein set forth, reference being made to the following claims rather than to the specific descriptions herein to indicate the scope of this invention.

Having described the invention, what is claimed is:

1. In a device for uniformily positioning wire mesh reinforcement in the preparation of concrete slabs at a predetermined point above the bed of the slab, comprising, a stake having a bladed angular base, pointed at its lower end to facilitate insertion in the bed for the slab;

a slotted top plate secured to the top of the stake;

a U-Shaped casing, open at its top and outer side, secured to the upper half of the base of the stake, the open top being aligned with the slot in the top plate;

a lifting arm pivotally mounted within the lower end of the casing and having an open connecting means at the upper end thereof;

the slotted top plate of the stake adapted to receive a lifting wire supporting wire mesh reinforcement, the lifting wire having connecting means secured thereto to engage corresponding means at the upper end of the lifting arm, so that when the lifting wire is moved laterally, the lifting arm is moved through an arc to vertical position, raising the lifting wire together with the wire mesh reinforcement to a predetermined position above the bed of the slab.

2. A device of the type set forth in claim 1, wherein the stake has a three-bladed triangular base having a cross-section in the form of a three pointed star.

3. A device of the type set forth in claim 1, in which the connecting means at the upper end of the lifting arm is in the form of a loop.

4. A device of the type set forth in claim 1, in which the connecting means secured to the lifting wire is in the form of a loop.

5. A device of the type set forth in claim 1, in which the connecting means at the upper end of the lifting arm is in the form of a loop and in which the connecting means on the lifting wire is in the form of a hook secured to the lifting wire by welding.

6. A device of the type set forth in claim 1, in which the pivotally mounted lifting arm is adapted to move through an arc of about 45 degrees to a vertical position.

7. A device of the type set forth in claim 1, in which the center of the arc of the lifting arm is below the base of the slab.

* * * * *